United States Patent [19]

Toya et al.

[11] Patent Number: 5,019,494

[45] Date of Patent: May 28, 1991

[54] SILVER HALIDE PHOTOGRAPHIC MATERIAL

[75] Inventors: Ichizo Toya; Ryoichi Nemori, both of Kanagawa, Japan

[73] Assignee: Fuji Photo Film Co., Ltd., Kanagawa, Japan

[21] Appl. No.: 315,865

[22] Filed: Feb. 27, 1989

[30] Foreign Application Priority Data

Feb. 26, 1988 [JP] Japan ..... 63-43504

[51] Int. Cl.[5] ..... G03C 1/10; G03C 1/04

[52] U.S. Cl. ..... 430/600; 430/531; 430/536; 430/537; 430/628; 430/629; 430/639; 430/640; 430/641

[58] Field of Search ..... 430/628, 629, 630, 639, 430/640, 641, 600, 599, 539, 537, 531, 536, 601, 603, 602

[56] References Cited

U.S. PATENT DOCUMENTS

| | | | |
|---|---|---|---|
| 3,063,838 | 11/1962 | Jennings | 430/639 |
| 3,272,631 | 9/1966 | Garrett et al. | 430/564 |
| 3,762,924 | 10/1973 | Morii et al. | 430/631 |
| 4,357,418 | 11/1982 | Cellone | 430/539 |
| 4,710,456 | 12/1987 | Naoi et al. | 430/628 |
| 4,916,049 | 4/1990 | Toya | 430/628 |
| 4,920,032 | 4/1990 | Toya et al. | 430/628 |

FOREIGN PATENT DOCUMENTS

| | | | |
|---|---|---|---|
| 745104 | 10/1966 | Canada | 430/639 |
| 0219101 | 4/1987 | European Pat. Off. | 430/639 |

*Primary Examiner*—Richard L. Schilling

*Attorney, Agent, or Firm*—Sughrue, Mion, Zinn, Macpeak & Seas

[57] ABSTRACT

A silver halide photographic material which comprises a support having thereon at least one hydrophilic colloid layer, wherein the hydrophilic colloid layer comprises (a) a binder comprising a dextran having a molecular weight of at least 100,000 and (b) an ionic polymer.

7 Claims, No Drawings

SILVER HALIDE PHOTOGRAPHIC MATERIAL

FIELD OF THE INVENTION

This invention concerns a silver halide photographic material and, more particularly, it concerns a silver halide photographic material which has improved sensitivity and which is suitable for prolonged coating.

BACKGROUND OF THE INVENTION

Considerable interest has been shown in the manufacture of emulsions in the increase of sensitivity.

The use of various additives in silver halide photographic emulsions is known as a means of increasing the sensitivity.

Dextran is a typical example of a sugar which increases the sensitivity of a photographic emulsion layer and its use has been disclosed, for example, in U.S. Pat. Nos. 3,063,833 and 3,272,631. However, the following problem arises during development processing when amounts of these materials sufficient for achieving the intended purpose are used.

Specifically, the photographic emulsion layer peels away from the subbing layer, e.g., a layer which is established to ensure adhesion between the photographic emulsion layer and the support, during development processing. The product value of such a photographic material is considerably low.

The method of eliminating such peeling during development processing by simply arranging the proportion of dextran to a binder in the photographic emulsion layer, as disclosed in JP-A-61-69061 is known to be inadequate for maintaining product value (the term "JP-A" as used herein refers to a "published unexamined Japanese patent application"). The use of a dextran having a molecular weight of at least 100,000 as suggested in Japanese Patent Application No. 62-313637 is satisfactory as a means of preventing such peeling; however, when the dextran is added, it precipitates out of the coating liquid and the liquid cannot be used for coating over prolonged periods.

SUMMARY OF THE INVENTION

An object of the present invention is to provide photographic materials which have improved sensitivity and which are suitable for coating over prolonged periods of time.

The object of the present invention is attained by a silver halide photographic material which comprises a support having thereon at least one hydrophilic colloid layer, wherein the hyirophilic colloid layer comprises (a) a binder comprising a dextran having a molecular weight of at least 100,000 and (b) an ionic polymer.

DETAILED DESCRIPTION OF THE INVENTION

The ionic polymers used in the invention include water-soluble synthetic polymers which contain a repeating unit represented by formula (P) below, and natural water-soluble ionic polymers and derivatives thereof.

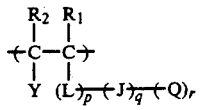

(P)

In this formula, $R_1$ and $R_2$ may be the same or different, and each represents a hydrogen atom, an alkyl group, preferably an alkyl group which has from 1 to 4 carbon atoms (which may have one or more substituent groups; for example, methyl, ethyl, propyl, butyl), a halogen atom (for example, chlorine), or —$CH_2COOM$ wherein M represents a hydrogen atom or a cation group; Y represents a hydrogen atom or a carboxyl group including a salt thereof; L represents —CONH—, —NHCO—, —COO—, —OCO—, —CO—, —$SO_2$—, —$NHSO_2$—, —$SO_2NH$— or —O—; J represents an alkylene group, preferably an alkylene group which has from 1 to 10 carbon atoms (which may have one or more substituent groups; for example, methylene, ethylene, propylene, trimethylene, butylene, hexylene, 2,2 -dimethylethylene, 2-hydroxypropylene), an arylene group, preferably an arylene group which has from 1 to 15 carbon atoms (which may have one or more substituent groups; for example, phenylene, 2-methylphenylene), an aralkylene group, preferably an aralkylene group which has from 7 to 16 carbon atoms (which may have one or more substituent groups; for example,

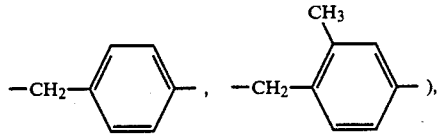

—$CH_2CH_2O)_m$—$(CH_2)_n$—, or

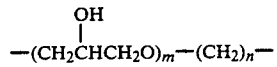

(wherein m is an integer of from 0 to 40 and n is an integer of from 0 to 4); Q represents —COOM, —$SO_3M$,

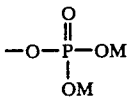

or —OM, and represents preferably —COOM wherein M represents a hydrogen atom or a cation group; p and q each represents 0 or 1; and r is an integer, preferably 1 or 2, and most preferably 1.

Further, the synthetic water-soluble monomers of the present invention can be copolymerized with ethylenic unsaturated monomers. Examples of copolymerizable ethylenic unsaturated monomers include styrene, alkylstyrenes, hydroxyalkylstyrenes (wherein the alkyl group has from 1 to 4 carbon atoms, for example, methyl, ethyl, butyl), vinylbenzenesulfonic acids and salts thereof, α-methylstyrene, N-vinylpyrrolidone, monoethylenic unsaturated esters of fatty acids (for example, vinyl acetate, vinyl propionate), ethylenic unsaturated mono- or di-carboxylic acids or salts thereof (for example, acrylic acid, methacrylic acid), maleic anhydride, esters of ethylenic unsaturated mono- or dicarboxylic acids (for example, n-butyl acrylate, dimethyl maleate) and amides of ethylenic unsaturated mono- or dicarboxylic acids (for example, acrylamide, 2-acrylamido-2-methylpropanesulfonic acid sodium salt).

The synthetic water-soluble polymers used in the present invention are polymers which have from about 1 to 100 mol %, and preferably from about 5 to 100 mol %, of a repeating unit which is represented by formula (P).

Specific examples of synthetic water-soluble polymers which have a repeating unit represented by formula (P) are indicated below. However, the present invention should not be construed as being limited thereto.

P-1

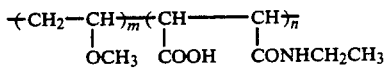

m:n = 50:50 (mol %)

P-2

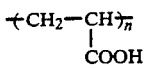

P-3

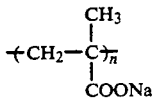

P-4

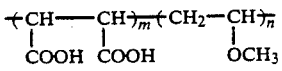

m:n = 50:50 (mole %)

P-5

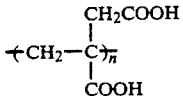

P-6

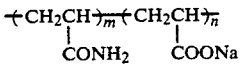

m:n = 90:10 (mole %)

P-7

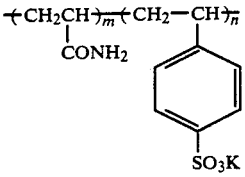

m:n = 95:5 (mole %)

P-8

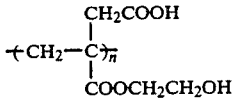

P-9

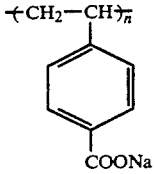

P-10

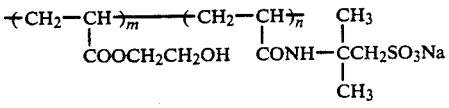

m:n = 80:20 (mol %)

-continued

P-11

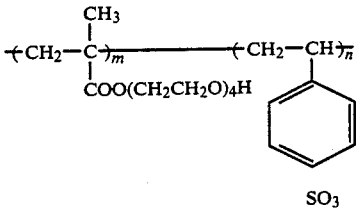

m:n = 50:50 (mole %)

P-12

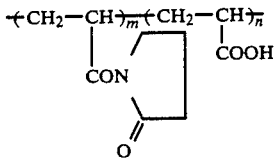

m:n = 97:3 (mol %)

P-13

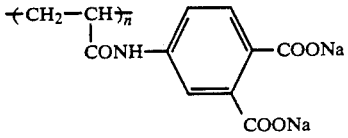

P-14

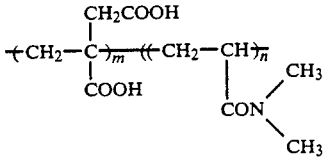

m:n = 15:85 (mol %)

P-15

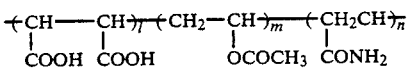

l:m:n = 15:25:60 (mole %)

The molecular weight of the synthetic water-soluble polymers of the present invention ranges from about 1,000 to 1,000,000, and preferably from about 2,000 to 300,000.

Anionic polymers, and most desirably carboxylic acid-based polymers, are the preferred natural ionic polymers. Examples of preferred polymers include alginic acid, gum arabic, pectinic acid and gum tragacanth.

Furthermore, derivatives of natural water-soluble polymers which can be used in the present invention include dextran sulfate esters, carboxyalkyl dextrans, cellulose sulfate esters, carboxyalkyl cellulose, pullulan sulfate esters and carboxyalkyl pullulans. The molecular weight of these natural ionic water-soluble polymer derivatives is preferably from about 1,000 to 1,000,000, and most preferably from about 2,000 to 300,000.

The synthetic water-soluble polymers and the derivatives of natural water-soluble polymers used in the present invention can be prepared by the methods as disclosed in JP-B-35-11989, U.S. Pat. No. 3,762,924, JP-B-45-12820, JP-B-45-18418, JP-B-45-40149 and JP-B-46-31192 (the term "JP-B" as used herein refers to an "examined Japanese patent publication").

In the present invention, the hyirophilic colloid layer comprising a binder, a dextran having a molecular weight of at least 100,000, and an ionic polymer (hereinafter referred to as the "dextran-containing layer") preferably is a silver halide photographic emulsion layer.

It is also preferable that a hydrophilic colloid layer containing dextran and having a dry film thickness of at least 1 μm exists on the side nearer to the support than the dextran-containing layer.

The weight average molecular weight ($\overline{M}w$) of the dextran used in the present invention is at least 100,000, preferably from 120,000 to 200,000, and particularly preferably from 120,000 to 180,000. The amount of such a dextran to be added may vary, but the optimum amount thereof depends on the kind of photographic emulsion employed.

The dextran-containing layer of the present invention is obtained by lowering the molecular weight of a native dextran by a partial decomposition polymerization method using an acid, an alkali, or an enzyme. The native dextran is obtained by reacting a dextran producing bacteria such as leuconostock, mesenteleudies, etc., or a dextran succhrase separated from the cultivated liquid of the bacterial with a sucrose solution.

The addition amount of dextran is preferably from 5 to 50% by weight and more preferably from 5 to 30% by weight of the total amount of the binder including dextran in the dextran-containing layer.

The coated amount of the dextran-containing layer is preferably 3 g/m$^2$ or more.

When dextran is added to a photographic emulsion, the dextran may be added thereto at any time but it is proper to add the dextran from after the second ripening to before coating the emulsion.

Dextran may be added as a powder but it is preferable to add dextran as an aqueous 5 to 30 wt % solution thereof.

The aforesaid hydrophilic colloid layer containing no dextran for use in this invention is preferably disposed adjacent to a subbing layer for support.

The dry thickness of the layer which does not contain dextran is preferably from 1.0 μm to 5.0 μm, and more preferably from 1.0 μm to 3.0 μm. If the thickness thereof is less than 1.0 μm, it is necessary to prevent the diffusion of low molecular weight components of dextran from the upper layer(s) containing dextran to the subbing layer otherwise the adhesion between the hydrophilic colloid layer which does not contain dextran and the subbing layer is reduced.

If the molecular weight of the dextran used in the present invention is too large, the sensitizing effect for photographic emulsion is undesirably not remarkable, while if the molecular weight thereof is too small, the adhesion between the emulsion layer and the subbing layer may be reduced.

The amount of water-soluble ionic polymer which is used together with the dextran in the present invention is from 1/100 to 10, preferably from 1/50 to 1, and most preferably from 1/30 to ⅓, by weight with respect to the amount of dextran.

Other structural features of the silver halide photographic material of the present invention are described below.

The silver halide grains used for the silver halide -photographic emulsions of the present invention may have a regular crystal form such as cubic, octahedral, etc., an irregular crystal form such as spherical, tabular, etc., or a composite form of these crystal forms. Furthermore, the silver halide grains may be composed of a mixture of grains having various crystal forms.

The photographic emulsion for use in the present invention can be prepared by the methods described in P. Glafkides, *Chemie et Physique Photographique,* published by Paul Montel Co.; G. F. Duffin, *Photographic Emulsion Chemistry,* published by the Focal Press, 1966; and V. L. Zelikman et al., *Making and Coating Photographic Emulsion,* published by the Focal Press, 1964. The photographic emulsion can be prepared by an acid method, a neutralization method, an ammonia method, etc. Also, as a system of reacting a soluble silver salt and a soluble halide, a single jet method, a double jet method, or a combination thereof can be used.

Other binders for the photographic layers of the photographic light-sensitive materials of the present invention include proteins such as gelatin, casein, etc.; cellulose compounds such as carboxymethyl cellulose, hydroxyethyl cellulose, etc.; saccharides such as agar-agar, sodium alginate, starch derivatives, etc.; and synthetic hydrophilic colloids such as polyvinyl alcohol, poly-N-vinylpyrrolidone, polyacrylic acid copolymers and the derivatives or the partial decomposition products thereof. Of these, gelatin is preferably used as binder.

Gelatin for use in the present invention generally refers to a limed gelatin, an acid-treated gelatin, and an enzyme-treated gelatin. Gelatin containing high molecular weigh components as described in JP-A-62-87952 is preferred.

The dextran-containing layer of the present invention preferably contains gelatin in an amount of 50 to 95 wt % of the total binder.

The photographic material of the present invention can contain an alkyl acrylate series latex as described in U.S. Pat. Nos. 3,411,911 and 3,411,912, and JP-B-45-5331 in the constituting layers.

The silver halide emulsion for use in the present invention may be a primitive emulsion which is not chemically sensitized. For chemical sensitization, the methods described in P. Glafkides, *Chemie et Physique Photographique* and V. L. Zelikman et al., *Making and Coating Photographic Emulsion* described above as well as H. Frieser, *Die Grundlagen der Photographischen Prozesse mit Silberhalogeniden,* published by Akademische Verlagsgesellschasft, 1968 can be used.

Sensitization methods for use in the present invention include sulfur sensitization using a sulfur-containing compound capable of reacting with silver ions or active gelatin, reduction sensitization using a reducing material, and a noble metal sensitization method using a gold compound or a compound of other noble metal. These sensitization can be used alone or in combination.

More specifically, for the sulfur sensitization method, thiosulfates, thioureas, thiazoles, rhodanines, etc., can be used and specific examples of them are described in U.S. Pat. Nos. 1,574,944, 2,410,689, 2,278,947, 2,728,668 and 3,656,955. For the reduction sensitization method, stannous salts, amines, hydrazine derivatives, formamidine-sulfinic acid, silane compounds, etc., can be used. Also, for the noble metal sensitization methods, gold complex salts as well as complex salts of metals belonging to group VIII of the Periodic Table, such as platinum, iridium, palladium, etc., can be used.

The photographic light-sensitive material of the present invention can contain various compounds such as antifoggants and stailizers. Examples of such antifoggants and stabilizers include azoles such as benzothiazolium salts, nitroindaxoles, triazoles, benzotriazoles, benzimidaxoles (in particular, nitro-substituted produces or halogen-substituted products), etc.; heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyridines, etc.; the aforesaid heterocyclic mercapto compounds having a water solubilizing group such as a carboxy group and a sulfone group; thioketo compounds such as oxaxolinethion, etc.; azaindenes such as tetraazaindenes (in particular 4-hydroxy-substituted (1,3,3a,7)tetraazaindenes), etc.; benzenthiosulfonic acids; and benzensulfinic acids.

Detailed specific examples of antifoggants and stabilizers and methods for using them are described in U.S. Pat. Nos. 3,954,474, 3,982,947 and 4,021,248, and JP-B-52-28660.

The photographic light-sensitive material of the present invention can contain a hardening agent. Specific examples of the hardening agent for use in the present invention are aldehyde series compounds such as mucochloric acid, formaldehyde, dimethylolurea, glyoxal, succinaldehyde, glutaraldehyde, etc.; active vinyl compounds such as divinylsulfone, methylenebismaleinimide, 5-acetyl-1,3-diacryloyl-hexahydro-s-trizine, 1,3,5-triacryloyl-hexahydro-s-triazine, 1,3-bis(vinylsulfonylmethyl)ether, 1,3-bis(vinylsulfonyl) propanol-2, bis(α-vinylsulfonylacetamido)ethane, bis(vinylsulfonyl)methane, etc.; active halogen series compounds such as 2,4-dichloro-6-hydroxy-s-triazine sodium salt, etc.; N-carbamoylpyridinium salts such as (1-morpholineocarbonyl-3-pyridinio)methane sulfonate, etc.; haloamidinium salts such as 1-(1-chloro-1 -pyridinomethylene)pyrrolidinium, 2-naphthalenesulfonate, etc.; and inorganic compounds such as chromium alum, etc.

The photographic light-sensitive material of the present invention may further contain, in the photographic emulsion layer(s) and/or other constituting layers, various surface active agents for use as coating aids, as antistatic agents for improvement of sliding properties, for improvement of emulsification and dispersibility, for prevention of adhesion, and for improvement of photographic characteristics (e.g., development acceleration, increase of contrast, increase of sensitivity, etc.).

Surface active agents include nonionic surface active agents such as saponin (steroid series), alkylene oxide derivatives (e.g., polyethylene glycol, a polyethylene glycol/polypropylene glycol condensate, polyethylene glycol alkyl ethers, polethylene glycol alkylaryl ethers, polyethylene glycol esters, polyethyelne glycol sorbitan esters, polyalkylene glycol alkylamines, polalkylene glycol alkylamides, and polyethylene oxide adducts of silicone), glycidol derivatives (e.g., alkyenylsuccinic acid polyglyceride and alkylphenol polyglyceride), fatty acid esters of polyhydric alcohol, alkyl esters of saccharide; anionic surface active agents containing an acid group such as a carboxy group, a sulfo group, a phospho group, a sulfuric acid ester group, a phosphoric acid ester group, etc. (e.g., alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkylpolyoxyehtylene alkylphenyl ethers, and polyoxyethylene alkylphosphoric acid esters), etc.; amphoteric surface active agents such as aminoacides, aminoalkylsulfonic acids, aminoalkylfulfuric acid esters, aminoalkylphosphoric acid esters, alkylbetaines, amine oxides, etc.; and cationic surface active agents such as alkylamine salts, aliphatic quaternary ammonium salts, aromatic quaternary ammonium salts, heterocyclic quaternary ammonium salts (e.g., pyridiniums and imidazoliums), and phosphonium or sulfonium salts containing an aliphatic ring or a heterocyclic ring.

The photographic emulsion for use in the present invention may be spectrally sensitized by methine dyes, etc. The dyes which are thus used include cyanine dyes, merocyanine dyes, complex cyanine dyes, complex merocyanine dyes, holopolar cyanine dyes, hemicyanine dyes, styryl dyes, and hemioxonol dyes. Particularly useful are the cyanine dyes, merocyanine dyes, and complex merocyanine dyes.

Nuclei ordinarily utilized for cyanine dyes such as basic hetercyclic nuclei can be applied to these dyes. These include: pyrroline nuclei, oxazoline nuclei, thiaxoline nuclei, pyrrole nuclei, oxazole nuclei, thiazole nuclei, selenazole nuclei, etc.; nuclei formed by fusing an aliphatic hydrocarbon ring to the aforesaid nuclei, and the nuclei formed by fusing an aromatic hydrocarbon ring to the aforesaid nuclei, such as indolenine nuclei, benzindolenine nuclei, indole nuclei, benzoxazole nuclei, naphthoxazole nuclei, benzothiazole nuclei, naphthothiazole nuclei, benzosenenazole nuclei, benzimidazole nuclei, quinoline nuclei, etc., can be applied for the dyes described above. Carbon atoms on these nuclei may be substituted.

For merocyanine dyes or complex merocyanine dyes, 5-membered or 6-membered hetercylic nuclei may be applied such as pyrazoline-5-one nuclei, thiohydantoin nuclei, 2-thiooxazolidone-2,4-dione nuclei, thiazolidine-2,4-dione nuclei, rhodanine nuclei, thiobarbituric acid nuclei, etc., as a nucleus having a ketomethylene structure.

Typical examples of the support for the photographic light-sensitive material of the present invention include cellulose nitrate films, cellulose acetate films, polyvinylacetal films, polystyrene films, polyethylene terephthalate films, polyester films, papers, glass sheets, metal sheets, wood plates, etc.

The present invention is illustrated in more detail with reference to the following examples, although the present invention is not limited thereto. Unless indicated otherwise, all parts, percents, ratios, etc., are by weight.

EXAMPLE 1

(1) Preparation of Light-Sensitive Silver Halide Emulsion

Potassium bromide and potassium iodide, and silver nitrate were added with vigorous stirring to an aqueous gelatin solution and thick, tabular silver iodobromide emulsion (average iodide content 10 mol %) of average grain diameter 1 μm was prepared. Next, the mixture was washed using the normal precipitation method, the dye, Dye-1, was added and then the emulsion was chemically sensitized by means of the gold/sulfur sensitization method using chloroauric acid and sodium thiosulfate to provide a light-sensitive silver iodobromide Emulsion A. A thick, tabular 0.7 μm silver halide Emulsion B (average iodide content 6 mol %) was prepared in the same way as the silver halide Emulsion A except that the amount of potassium iodide added and the temperature during the preparation were adjusted.

(2) Preparation of Coated Samples

Each of Samples 1 to 14 was prepared by simultaneously forming the following layers on a triacetyl cellulose support having a backing layer shown below on the opposite side of the following layers in this order.

Backing Layer

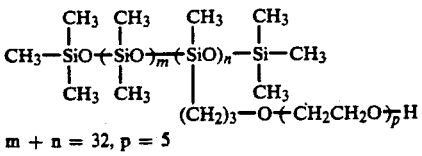

m + n = 32, p = 5 — 10 mg/m²

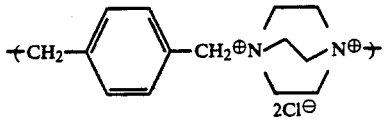

60 mg/m²

Diacetylcellulose — 140 mg/m²
Silicon Oxide — 5 mg/m²

Lowermost Layer

Binder: Gelatin — 1 g/m²
Coating Aid: Potassium Poly-p-styrenesulfonate — 10.0 mg/m²

Binder Layer

Surfactant: 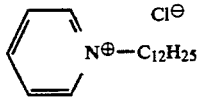 — 6 mg/m²

Binder: Gelatin — 1 g/m²
Fixing Accelerator: — 0.16 g/m²

E-1 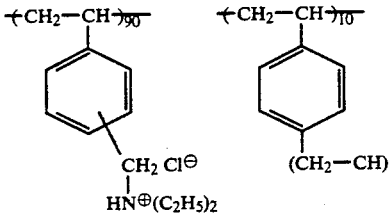

Dye-8 (shown below) — 24 mg/m²
Dye-27 (shown below) — 15 mg/m²

Dye-8 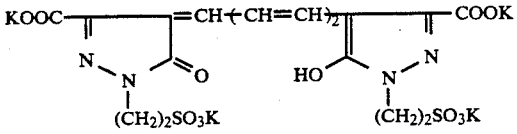

Dye-27 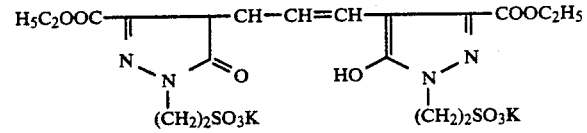

Intermediate Layer

Binder: Gelatin — 0.4 g/m²
Coating Aid: Potassium Poly-p-styrenesulfonate — 3.3 mg/m²

Emulsion Layer 1

Emulsion B — 1.5 g/m² as silver

Binder: Gelatin — 2 g/m²
Sensitizing Dye: Dye-1 (shown below) — 2.1 mg/g of silver Additive: $C_{18}H_{35}O-(CH_2CH_2O)_{20}-H$ — 5.8 mg/g of silver Coating Aid: Potassium Poly-p-styrenesulfonate — 50 mg/m²
Hardening Agent: 1,2-Bis(vinyl-sulfonylacetamido)ethane — 45 mg/m²

Emulsion Layer 2

Emulsion A — 4 g/m² as silver

Dextran (shown in Table 1) — 1.4 g/m²
Ionic Polymer (shown in Table 1)
Binder: Gelatin — 4.2 g/m²
Sensitizing Dye: Dye-1 (shown below) — 2.1 mg/g of silver -continued

| | |
|---|---|
| Additives: $C_{18}H_{35}O-(CH_2CH_2O)_{20}-H$ | 5.8 mg/g of silver |
| Trimethylolpropane | 420 mg/m$^2$ |
| Coating Aid: Potassium Poly-p-styrenesulfonate | 100 mg/m$^2$ |

Dye-1

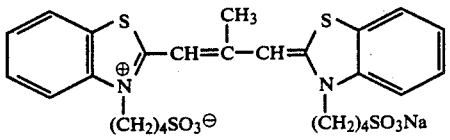

Surface Protective Layer

| | |
|---|---|
| Binder: Gelatin | 0.7 g/m$^2$ |
| Slip Agent: | 40 mg/m$^2$ |

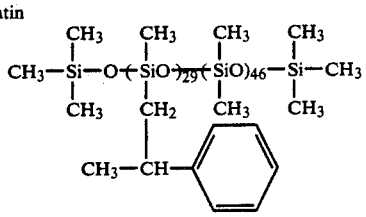

| | |
|---|---|
| Coating Aid: | 10 mg/m$^2$ |

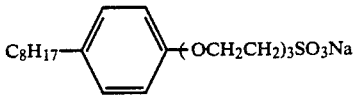

| | |
|---|---|
| Matting Agent: Fine Poly(methyl methacrylate) particles (average particle size 3 μm) | 0.13 mg/m$^2$ |

(3) Sensitometry

Each of the samples obtained was stored for 14 days following preparation thereof under the conditions of 30° C. and 65% relative humidity and then tested as follows:

(i) Wet Adhesive Test (peeling test)

In a processing solution, two crossed scratches are formed on the photographic emulsion layer of each sample by scratching the layer using a stylus. The scratched portion is rubbed by finger tip in a direction perpendicular to the scratched line in each step of development, fixing, and washing.

A sample showing no peeling of the emulsion layer greater than that of the scratch is designated Grade A. A sample showing a maximum peeling width of 3 mm or less is designated Grade B. A sample which shows peeling greater than 3 mm is designated Grade C.

(ii) Measurement of Sensitivity

Each sample was exposed to a tungsten lamp of 400 lux through an optical wedge for 1/10 second and then developed by the developing solution shown below for 7 minutes at 20° C. The sample was then fixed by the fixing solution shown below, washed and dried. On each sample thus processed, the relative sensitivity was measured in a relative value of an exposure (E) that gives a constant density, ΔlogE (an optical density of 0.2) taking the relative sensitivity of Sample 1 as 100 (standard).

| Developing Solution: | |
|---|---|
| Metol | 2 g |
| Sodium Sulfite | 100 g |
| Hydroquinone | 5 g |
| Borax.10$H_2O$ | 2 g |
| Water to make | 1 liter |

Fixing Solution

The fixing solution employed is sold under the trade name Fuji Fix; made by the Fuji Photo Film Co., Ltd.

(4) Precipitation in the Coating Liquid

The coating liquid was left to stand at 40° C. and precipitation was evaluated by means of the value obtained by dividing the amount of supernatant liquid after 3 hours by the total amount of liquid.

o: Less than 5% x: 5% or above

The sensitometric measurements were made with samples coated with a coating liquid prior to precipitation.

The results obtained are shown in Table 1.

TABLE 1

| | | Emulsion Layer 2 | | | | | |
|---|---|---|---|---|---|---|---|
| | | Liquid Composition | | | | | |
| Sample | Molecular Weight of the Dextran | Gelatin (wt %) | Dextran (wt %) | Anti-Precipitant (%) | Precipitation | Sensitivity | Peeling Test |
| 1 (Comparison) | — | 7.9 | — | — | O | 100 | A |
| 2 (Comparison) | 40,000 | " | 2.7 | — | O | 210 | C |
| 3 (Comparison) | 40,000 | " | " | P-2 (Mw = 40,000) 0.3 | O | 210 | B–C |
| 4 (Comparison) | 70,000 | " | " | — | O | 210 | C |

TABLE 1-continued

| Sample | Molecular Weight of the Dextran | Emulsion Layer 2 Liquid Composition Gelatin (wt %) | Dextran (wt %) | Anti-Precipitant (%) | Precipitation | Sensitivity | Peeling Test |
|---|---|---|---|---|---|---|---|
| 5 (Comparison) | 70,000 | " | " | P-2 (Mw = 40,000) 0.3 | O | 210 | B–C |
| 6 (Comparison) | 100,000 | " | " | — | X | 210 | B |
| 7 (Invention) | 100,000 | " | " | P-2 (Mw = 40,000) 0.3 | O | 210 | A |
| 8 (Comparison) | 140,000 | " | " | — | X | 207 | A |
| 9 (Invention) | 140,000 | " | " | P-2 (Mw = 40,000) 0.3 | O | 206 | A |
| 10 (Comparison) | 180,000 | " | " | — | X | 208 | A |
| 11 (Invention) | 180,000 | " | " | P-2 (Mw = 40,000) 0.3 | O | 206 | A |
| 12 (Invention) | 180,000 | 7.9 | 2.7 | P-2 (Mw = 40,000) 0.6 | O | 206 | A |
| 13 (Comparison) | — | " | — | P-2 (Mw = 40,000) 0.3 | O | 97 | A |
| 14 (Comparison) | — | " | — | P-2 (Mw = 40,000) 0.6 | O | 94 | A |

Samples 7, 9, 11 and 12 of the present invention had a high sensitivity and clearly performed well in the precipitation and adhesion tests.

EXAMPLE 2

(1) Preparation of Light-Sensitive Silver Halide Emulsion

Same as in Example 1.

(2) Preparation of Coated Samples

Each of Samples 15 to 19 were prepared by simultaneously forming the following layers on a triacetyl cellulose support in this order.

Emulsion Laver 1

Same as emulsion layer 1 in Example 1.

Emulsion Layer 2

Same as emulsion layer 2 in Example 1.

Surface Protective Layer

Same as the surface protective layer in Example 1.

(3) Sensitometry

Measurement of Sensitivity

Same as in Example 1.

(4) Precipitation in the Coating Liquid

Same as in Example 1.

The results obtained are shown in Table 2.

TABLE 2

| Sample | Molecular Weight of the Dextran | Emulsion Layer 2 Liquid Composition Gelatin (%) | Dextran (%) | Compound (%) | Precipitation | Sensitivity |
|---|---|---|---|---|---|---|
| 15 (Comparison) | — | 8.4 | — | — | O | 100 |
| 16 (Comparison) | 180,000 | " | 2.7 | — | X | 205 |
| 17 (Invention) | 180,000 | " | " | P-2 (Mw = 40,000) 0.4 | O | 205 |
| 18 (Invention) | 180,000 | " | " | Sodium Alginate (Mw = 100,000) 0.3 | O | 200 |
| 19 (Invention) | 180,000 | " | " | P-4 (Mw = 60,000) 0.3 | O | 205 |

It is clear that Samples 17 to 19 of the present invention had a high sensitivity and were not prone to precipitation.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having thereon at least one hydrophilic colloid layer, wherein said hydrophilic colloid layer comprises (a) a binder comprising a dextran having a molecular weight of at least 100,000 and (b) a synthetic water-soluble ionic polymer containing a repeating unit represented by formula (P):

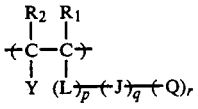

(P)

wherein $R_1$ and $R_2$ may be the same or different, and each represents a hydrogen atom, an alkyl group, a halogen atom, or $—CH_2COOM$ wherein M represents a hydrogen atom or a cation group; Y represents a hydrogen atom or a carboxyl group including a salt thereof; L represents —CONH—, —NHCO—, —COO—, —OCO—, —CO—, $—SO_2—$, $—NHSO_2—$, —$SO_2HN$— or —O—; J represents an alkylene group, an arylene group, an aralkylene group, $$\text{-}(CH_2CH_2O)_m\text{-}(CH_2)_n\text{-}, \text{ or } \text{-}(CH_2\overset{OH}{\overset{|}{C}}HCH_2O)_m\text{-}(CH_2)_n\text{-}$$

wherein m is an integer of from 0 to 40 and n is an integer of from 0 to 4; Q represents —COOM, —$SO_3M$,

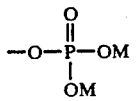

or —OM wherein M is defined as above;
p and q each represents 0 or 1; and r is an integer.

2. A silver halide photographic material as in claim 1, wherein said binder further comprises gelatin.

3. A silver halide photographic material as in claim 1, wherein said dextran is present in said hydrophilic layer in an amount of from 5 to 50% by weight of the total binder.

4. A silver halide photographic material as in claim 1, wherein said molecular weight of said dextran is from 120,000 to 200,000.

5. A silver halide photographic material as in claim 1, wherein said synthetic water-soluble ionic polymer has a molecular weight of from 1,000 to 1,000,000.

6. A silver halide photographic material as in claim 1, wherein said ionic polymer is present in said layer in an amount of from 1/100 to 10 times the weight of said dextran in said layer.

7. A silver halide photographic material as in claim 1 wherein r is 1.

* * * * *